US006622778B1

(12) United States Patent
Feldbauer

(10) Patent No.: US 6,622,778 B1
(45) Date of Patent: Sep. 23, 2003

(54) METHOD FOR THE DIRECT PRODUCTION OF SCALE-FREE THIN METAL STRIP

(75) Inventor: Stephen L. Feldbauer, Jackson Center, PA (US)

(73) Assignee: Danieli Technology, Inc., Cranberry Township, PA (US)

( * ) Notice: Subject to any disclaimer, the term of this patent is extended or adjusted under 35 U.S.C. 154(b) by 0 days.

(21) Appl. No.: 09/614,979

(22) Filed: Jul. 12, 2000

(51) Int. Cl.[7] ..... B22D 11/12

(52) U.S. Cl. ..... 164/475; 164/415; 164/476; 164/477

(58) Field of Search ..... 148/541, 546–548, 148/596, 625; 164/475, 415, 473, 476, 477

(56) References Cited

U.S. PATENT DOCUMENTS

| | | | | | |
|---|---|---|---|---|---|
| 2,625,495 | A | * | 1/1953 | Cone et al. | 134/2 |
| 3,623,532 | A | * | 11/1971 | Cofer et al. | 164/76 |
| 3,956,010 | A | * | 5/1976 | Kachik et al. | 134/2 |
| 5,042,564 | A | * | 8/1991 | Van Perlstein et al. | 164/476 |
| 5,092,393 | A | * | 3/1992 | Suehiro et al. | 164/476 |
| 5,329,688 | A | * | 7/1994 | Arvedi et al. | 29/527.7 |
| 5,816,311 | A | | 10/1998 | Osada et al. | 164/415 |
| 6,051,085 | A | * | 4/2000 | Tanaka et al. | 148/541 |

FOREIGN PATENT DOCUMENTS

| | | | |
|---|---|---|---|
| EP | 0 776 984 A1 | | 6/1997 |
| EP | 0 780 177 A 2 | | 6/1997 |
| WO | WO 90 00100 A | | 1/1990 |
| WO | WO 97 01401 | | 1/1997 |
| WO | WO-00/03815 | * | 1/2000 |
| WO | WO 00 12233 | | 3/2000 |

* cited by examiner

*Primary Examiner*—M. Alexander Elve
*Assistant Examiner*—Kevin McHenry
(74) *Attorney, Agent, or Firm*—Armstrong, Westerman & Hattori, LLP

(57) ABSTRACT

A method for the direct production, from molten metal, of scale-free thin metal strip. Hot thin metal strip exiting a continuous caster system is directed to a reducing chamber wherein a reducing gas reduces strip surface oxides while the cast metal strip is at an elevated temperature from retained heat from the molten metal. A cooling unit following the reducing chamber is used to cool the strip to a temperature below about 150° C. prior to exposing the strip to an oxidizing atmosphere. In various embodiments of the invention, strip thickness is reduced with use of hot and cold rolling mills and the scale-free surface of the strip is coated with protective coatings.

34 Claims, 6 Drawing Sheets

METHOD FOR THE DIRECT PRODUCTION OF SCALE-FREE THIN METAL STRIP

FIELD OF THE INVENTION

The present invention is a method and apparatus for the direct production from molten metal of scale-free, finished gage, metal strip by continuous casting of a hot thin strip. Surface oxide removal is with a reducing gas while the cast hot thin metal strip is at an elevated temperature from retained heat of the molten metal.

BACKGROUND OF THE INVENTION

Production of flat rolled steel strip, by current state-of-the-art processes, is carried out by continuously casting refined steel into a thin slab, followed by hot rolling of the slab to reach a thickness which can be put into coil form for subsequent processing. In that process, the surface of the coiled, hot rolled steel is heavily oxidized from processing steps carried out at an elevated temperature while being exposed to the atmosphere. Such oxides (scale) typically consist of $Fe_2O_3$, $Fe_3O_4$ and FeO. A next step in the production of the flat rolled steel strip typically involves removing the oxides by processing the strip in an acid pickling solution prior to rolling the strip to finished gage in a cold rolling mill.

Current methods of processing flat rolled steel strip require use of hot and cold rolling mill equipment requiring significant capital expenditures, large amounts of energy for operating, and a large plant facility for its installation. In addition, use of acid pickling solutions for removing surface oxides and disposal of spent acid solution, present environmental concerns which are resulting in more stringent regulations and increased costs for disposal.

In an effort to reduce or eliminate hot and cold rolling steps, methods are being developed to continuously cast thin strip which approaches finished gage thickness. Oxides are still present on the surface however and problems associated with oxide removal with use of acid pickling solutions continue to exist.

OBJECT OF THE INVENTION

It is the object of the present invention to provide a process for producing finished gage thin steel strip free of surface oxides, without the use of acid pickling solutions, and without the use of extensive hot and cold rolling equipment.

SUMMARY OF THE INVENTION

The present invention is a method and apparatus for the direct production of scale-free thin metal strip from molten metal by continuously casting molten metal into a hot thin metal strip and, while the cast strip still retains heat from the molten metal, passing it through a chamber containing a reducing gas to remove oxides from the surface of the strip so as to produce a metal strip free of surface oxides. The hot strip is then cooled to a temperature below about 150° C. prior to exposing the strip surface to any oxidizing atmosphere. In other embodiments of the invention, hot rolling of the hot thin metal strip and/or cold rolling of the cooled thin metal strip is carried out to reduce the strip thickness and modify mechanical properties of the metal. In still other embodiments of the invention the surface of the cooled thin metal strip is brushed, re-textured or coated with a protective or decorative coating.

Other specific features of the invention are described in more detail with reference being made to the accompanying drawings.

DETAILED DESCRIPTION OF THE INVENTION

Figure 1:
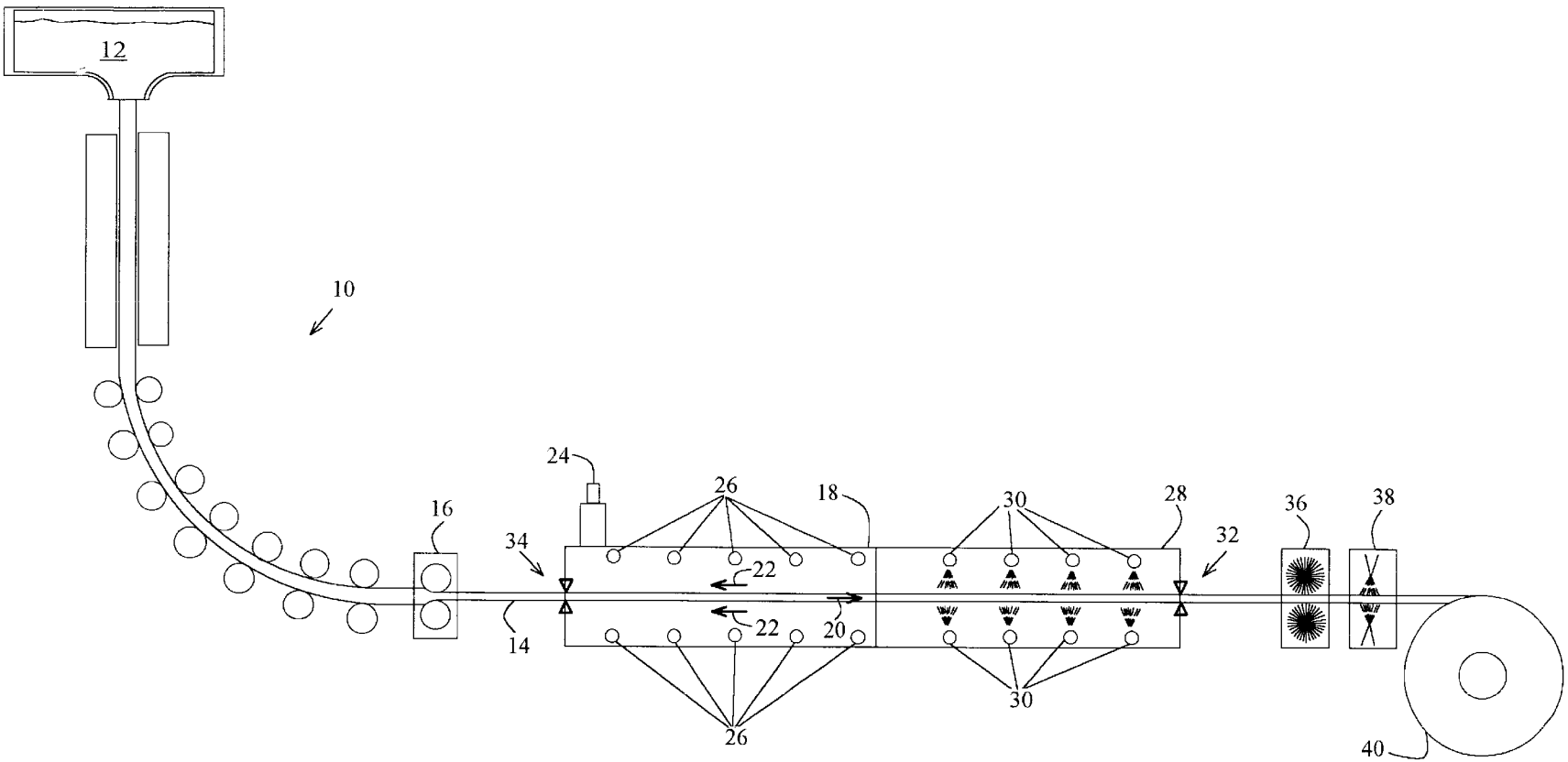
FIG. 1 is a schematic illustration of the process and apparatus of the invention for producing scale-free thin strip.

In FIGS. 1–6, numeral 10 generally denotes a thin strip continuous caster system for producing hot thin metal strip having a thickness of between about 0.5 and 4 mm. Molten metal 12, a product of an electric arc furnace, a BOF process, or other molten metal source is continuous cast into hot thin metal strip 14 which exits final casting rolls 16 of the continuous caster system. The molten metal, continuously cast into the hot thin metal strip, can be steel, stainless steel, copper, or other metals; however, the invention is disclosed in relation to production of scale-free thin steel strip.

The hot thin steel strip 14 exiting continuous caster system 10 retains heat from molten metal 12 and the continuous caster system is preferably controlled to discharge a hot thin metal strip having a surface temperature above about 400° C. The surface of the hot thin metal strip, which is usually exposed to a liquid cooling medium and to the atmosphere while being cast, is heavily oxidized with a surface oxide containing $Fe_2O_3$, $Fe_3O_4$, FeO, or combinations of those oxides, depending on conditions during the casting operation.

The hot thin metal strip 14, (FIG. 1) having a surface temperature of above about 400° C., enters reducing chamber 18, which encloses a reducing gas atmosphere. An example of a reducing chamber 18 is the type described in copending U.S. patent application Ser. No. 09/144,003 filed Aug. 31, 1998 in the name of Stephen L. Feldbauer, and in copending U.S. patent application Ser. No. 09/584,931 filed Jun. 1, 2000 in the names of Stephen L. Feldbauer and Brian Braho, both of which are assigned to the assignee of the present invention and both of which are incorporated herein by reference. Reducing chamber 18 contains a reducing gas such as hydrogen or carbon monoxide, with hydrogen being the preferred gas. Hot thin metal strip 14 moves through chamber 18 in a direction indicated by arrow 20 while movement of the reducing gas is generally in an opposite direction as indicated by arrows 22. The gas exits chamber 18 by way of vent 24 which can include a combustion means, such as a flame, for combusting unconsumed reducing gases exiting the chamber so as to provide for safe operation. Reduction of the strip surface oxides in the reducing chamber is optimized by providing a vigorous application of reducing gas to the surface of the strip. In a preferred embodiment the reducing gas is continuously introduced into the chamber through apertures in gas manifolds and directed toward the strip surface at a velocity which creates turbulence on impact with the strip. The reducing action of the gas on the surface oxides acts to reduce the oxides as well as undermine and loosen particles of oxide on the strip surface thus not requiring every oxide particle or oxide molecule to completely react with the reducing gas. Loosened oxides can be easily removed downstream by mechanical methods such as brushing, described below. To assure good contact of the reducing gas with strip 14, fans (not shown) can be placed within the reducing chamber to provide turbulence to the gas so as to optimize the reduction reaction.

For proper operation of the reducing process, the surface temperature of hot thin metal strip 14 is above about 400° C. The reducing reaction must take place during a very short period of time as the strip may be moving through the chamber at a speed up to 750 feet per minute. In a preferred embodiment, the hot thin metal strip is at the preferred temperature solely from heat retained in the strip from the molten metal continuous casting operation. Strip cooling is controlled during casting in continuous caster system 10, to provide sufficient heat for oxide removal in reducing chamber 18.

Means can be provided within reducing chamber 18 to heat the hot thin metal strip if the strip is not at the preferred temperature. In FIG. 1, radiant heaters 26 are shown, as an example, for providing heat to the strip. Heaters 26 may be used during continuous caster start-up periods or slow-down periods, which might be caused by caster operating problems, so as to provide for the proper temperature for the strip surface. Heaters 26 are also necessary if a strip accumulating means is provided intermediate strip caster system 10 and reducing chamber 18. A strip accumulating means is described below. In certain plants, use of heaters 26 may be required on a continual basis if optimum continuous caster operation does not allow a cast hot thin metal strip exit temperature as preferred.

In line, immediately following reducing chamber 18, is cooling unit 28 wherein hot thin metal strip 14 is cooled to a temperature below about 150° C. in an inert or reducing atmosphere. A reducing atmosphere is preferred as additional reduction of surface oxides can take place during an initial portion of the cooling process while the thin metal strip is still at an elevated temperature. Cooling unit 28 is preferably connected directly to reducing chamber 18 in order that thin metal strip 14 is not subjected to the atmosphere while at an elevated temperature.

Cooling is carried out in cooling unit 28 by introducing cooling gas through manifolds 30 and directing it toward the strip surface. The cooling gas is preferably an inert gas such as nitrogen combined with a reducing gas such as hydrogen. Seal 32 at the exit end of cooling unit 28 and seal 34 at the entrance end of reducing chamber 18 prevent oxidizing gases of the atmosphere from entering the system. A positive pressure within the reducing chamber and cooling unit helps to prevent the entrance of oxidizing gases.

As previously described, non-adhering particles of oxides can be present on the strip surface following the reduction reaction. Removal of those particles is accomplished with use of brushing unit 36 which provides brushes to act on the top and bottom surface of the cooled thin metal strip. Other suitable means can be employed for removal of the particles.

The scale-free cooled thin metal strip exiting brushing unit 36 is susceptible to oxidation, and, if not scheduled for immediate additional processing, can have an oil coating applied at coating station 38 prior to coiling at strip coiler 40. Alternative procedures can consist of applying other coatings at coating station 38 such as a protective organic coating applied with an organic coating unit or other more durable coatings such as hot-dipped galvanizing applied with a hot-dipped galvanizing unit or electrolytically plated coatings applied with an electrolytic plating unit.

Figure 2:
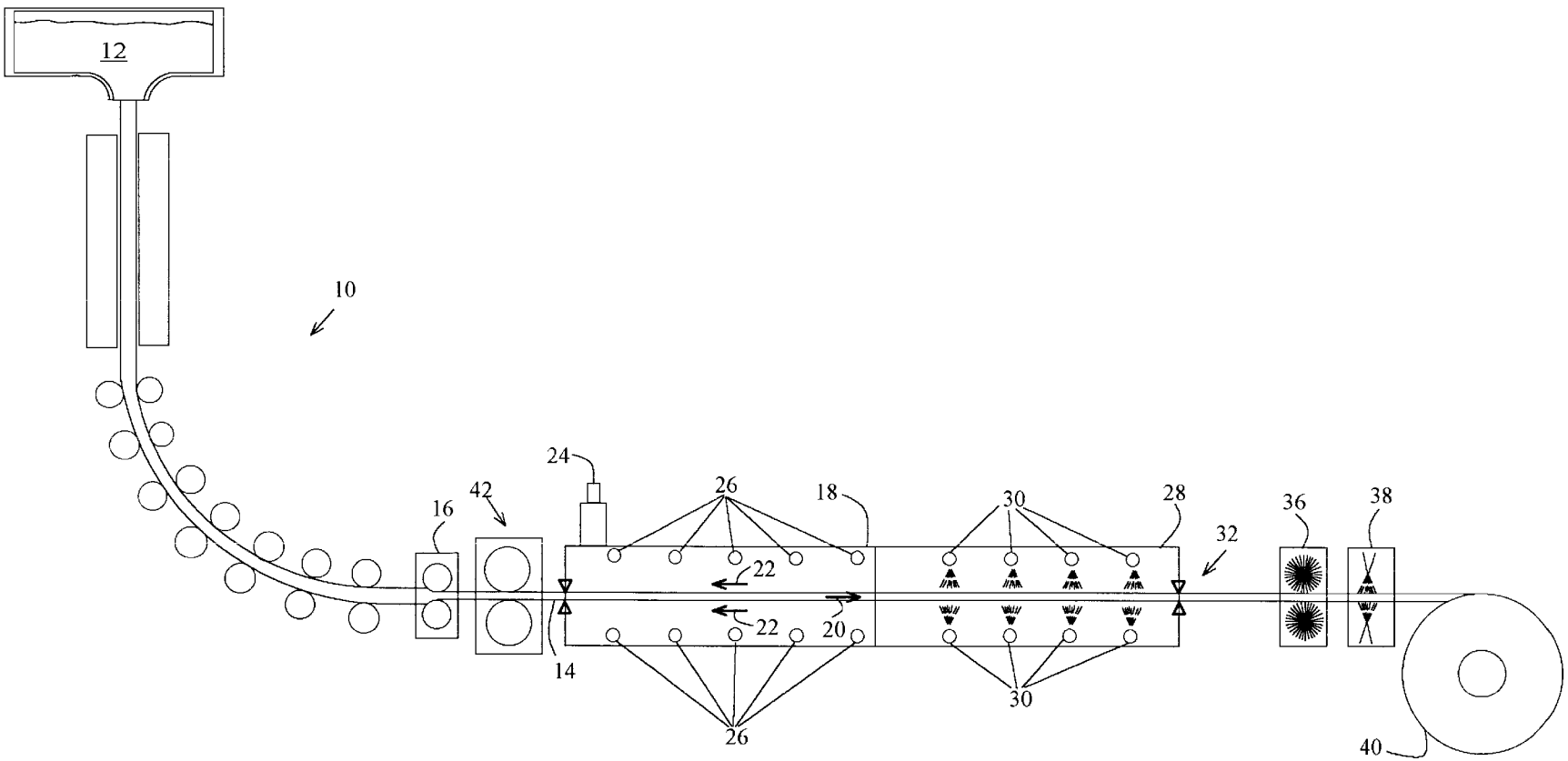
FIG. 2 is a schematic illustration of an embodiment of the process and apparatus of the invention for producing scale-free thin strip which incorporates a hot-rolling step prior to strip cleaning.

The process, as described in reference to FIG. 1, provides scale-free metal strip at a finished gage substantially equal to the gage of the continuously cast thin metal strip exiting continuous caster system 10. FIG. 2 depicts a production system wherein at least one hot-rolling mill 42 is provided intermediate continuous caster system 10 and reducing chamber 18. The configuration depicted in FIG. 2 provides a method and apparatus to conveniently reduce the finished gage of the strip from the thickness of the strip exiting the continuous caster system. Use of the hot-rolling mill, which results in a decrease in strip temperature, may require additional use of heaters 26 in reducing chamber 18 to provide the desired oxide reducing temperature; or, alternatively, the strip continuous caster system 10 can be controlled to exit the strip at a temperature higher than that preferred for the strip in reducing chamber 18.

Figure 3:
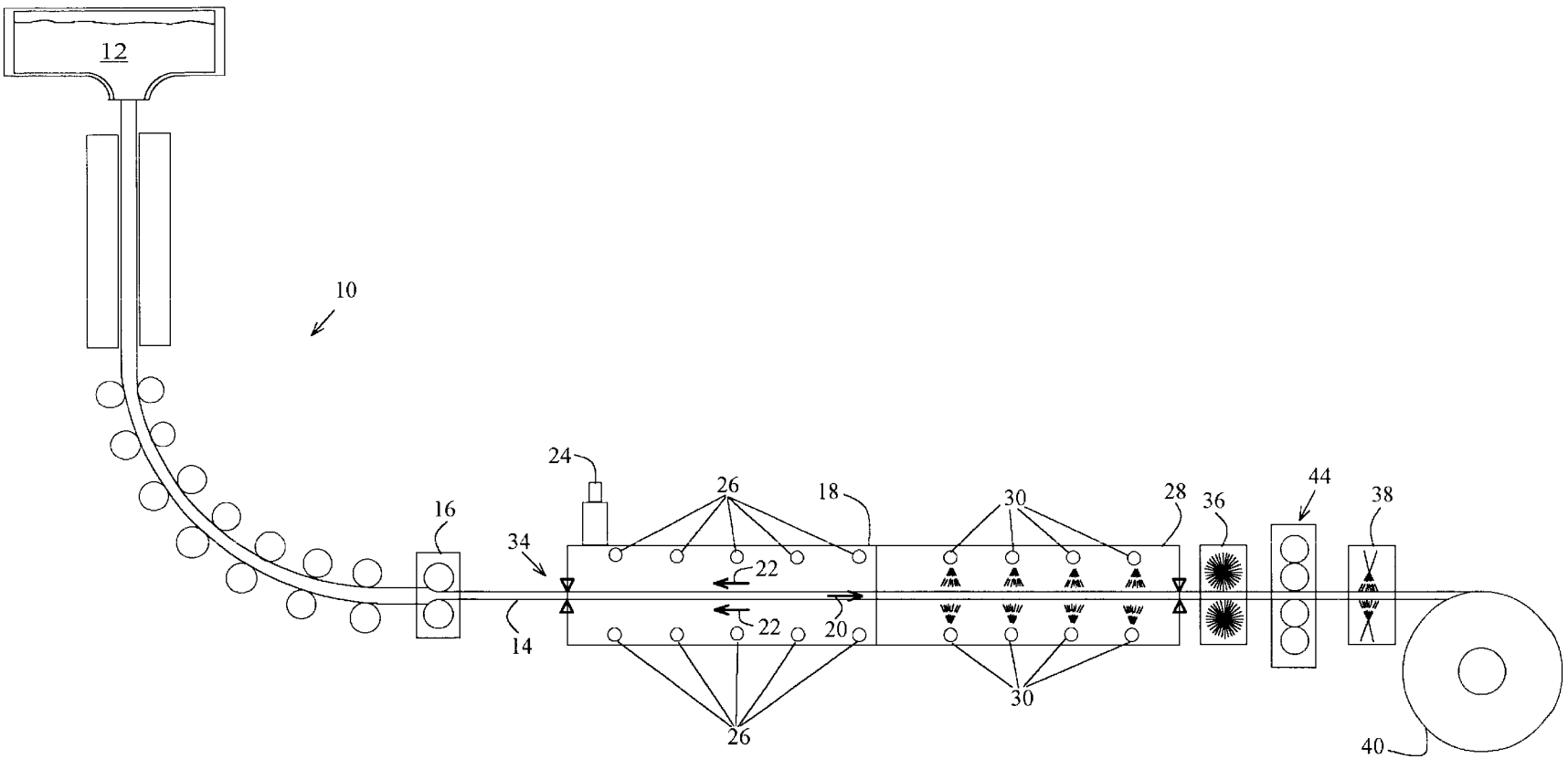
FIG. 3 is a schematic illustration of an embodiment of the process and apparatus of the invention for producing scale-free thin strip which incorporates a cold-rolling operation following a strip cooling step.

In FIG. 3, a method is depicted wherein at least one cold-rolling mill 44 is provided intermediate brushing unit 36 and coating station 38. Locating cold-rolling mill 44 following brushing unit 36 is preferred so as not to embed any loosened oxide particles into the surface of the metal strip during cold rolling.

The inclusion of cold-rolling mill 44 in the processing line enables production of a thin metal strip having a finished gage less than that of the strip exiting continuous caster system 10. Use of cold-rolling mill 44 can also provide a means for modifying mechanical properties of the strip. Use of cold-rolling mill 44 in combination with the hot-rolling mill, in a single processing line, can enable production of scale-free thin metal strip of various thicknesses having a range of mechanical properties. Thicknesses ranging from about 0.3 to 3.5 mm are possible using solely the hot-rolling or cold-rolling step, or the combined hot-rolling and cold-rolling step.

Figure 4:
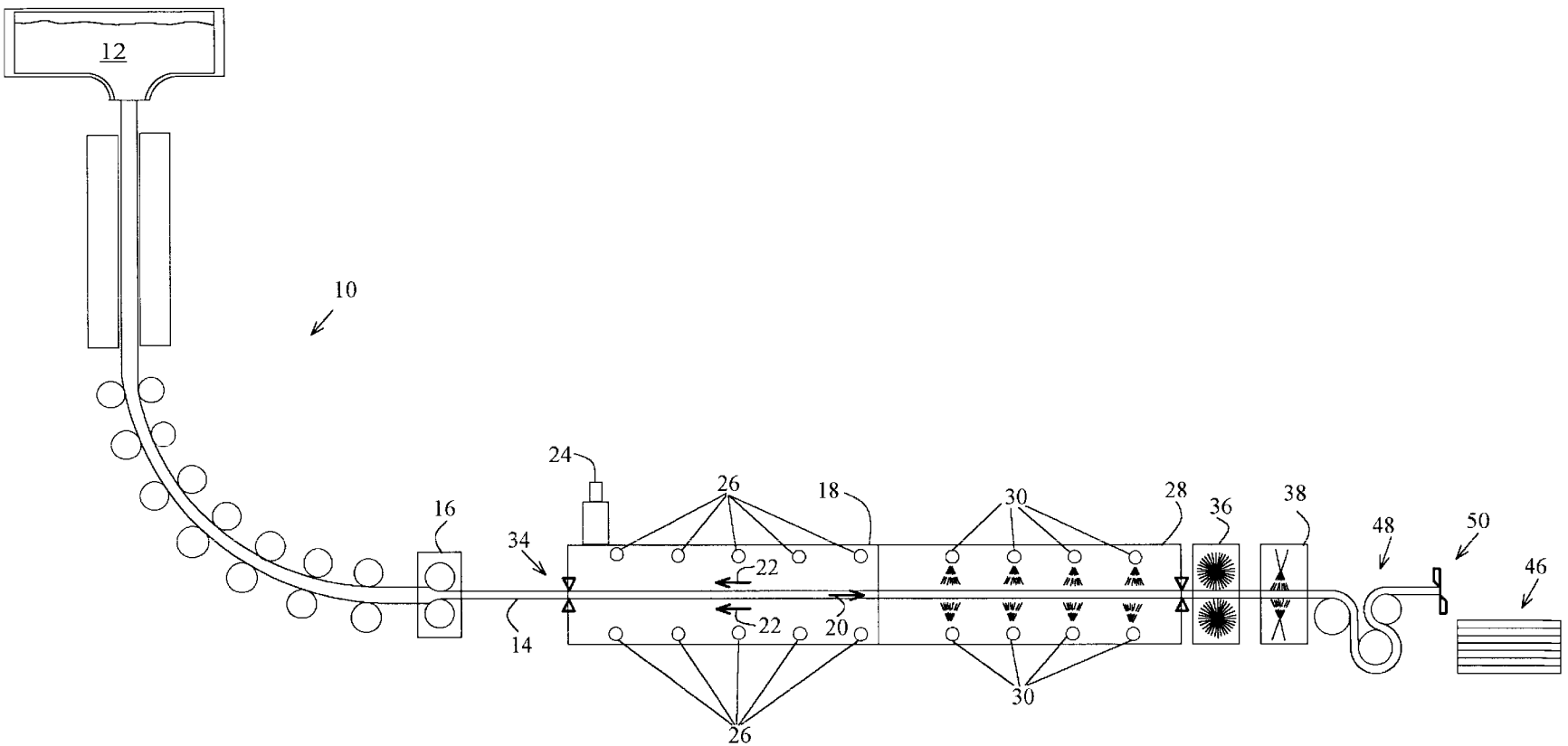
FIG. 4 is a schematic illustration of an embodiment of the process and apparatus of the invention for producing scale-free thin strip which incorporates means for shearing the strip into discreet pieces.

FIG. 4 depicts a processing line wherein discreet pieces of scale-free thin metal 46 are produced. The processing line for producing discreet pieces includes bridal rolls 48, or other means, for maintaining strip tension, followed by severing means such as shear 50 for severing the continuous strip into discreet pieces. Configuration of the processing line prior to shear 50 can be as described in any of the previous embodiments.

Figure 5:
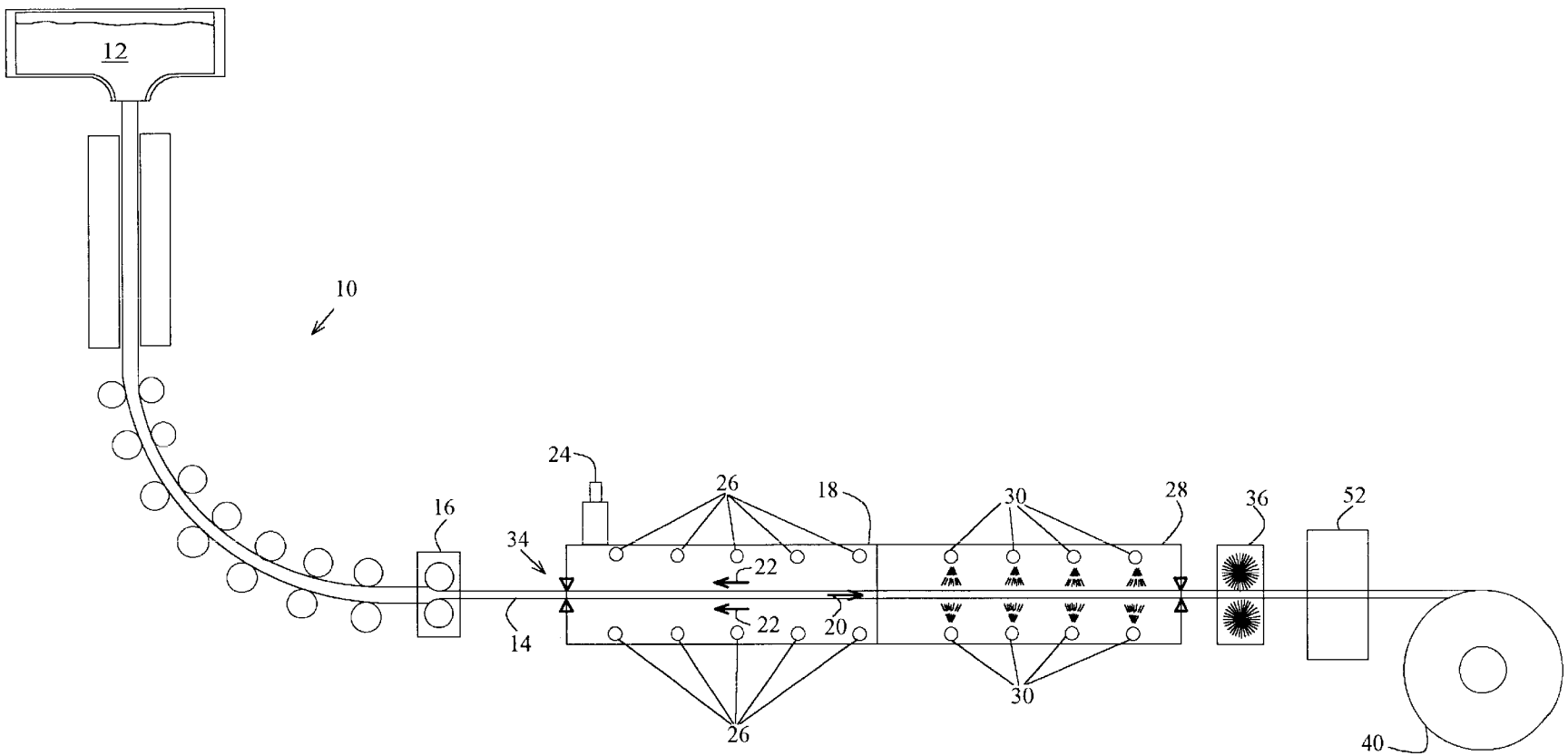
FIG. 5 is a schematic illustration of an embodiment of the process and apparatus of the invention for producing scale-free thin strip which incorporates a surface re-texturing step.

In FIG. 5, a processing station 52 is depicted having means for re-texturing the surface of thin metal strip 14. The re-textured surface can include, for example, an etched surface, obtained with use of a surface etching unit, a "brushed" surface appearance, obtained for example, with a wire brushing unit, an embossed surface, obtained with use of an embossing unit, etc. Although no rolling mill is shown in FIG. 5, rolling mills as depicted in configurations described above are possible.

Figure 6:
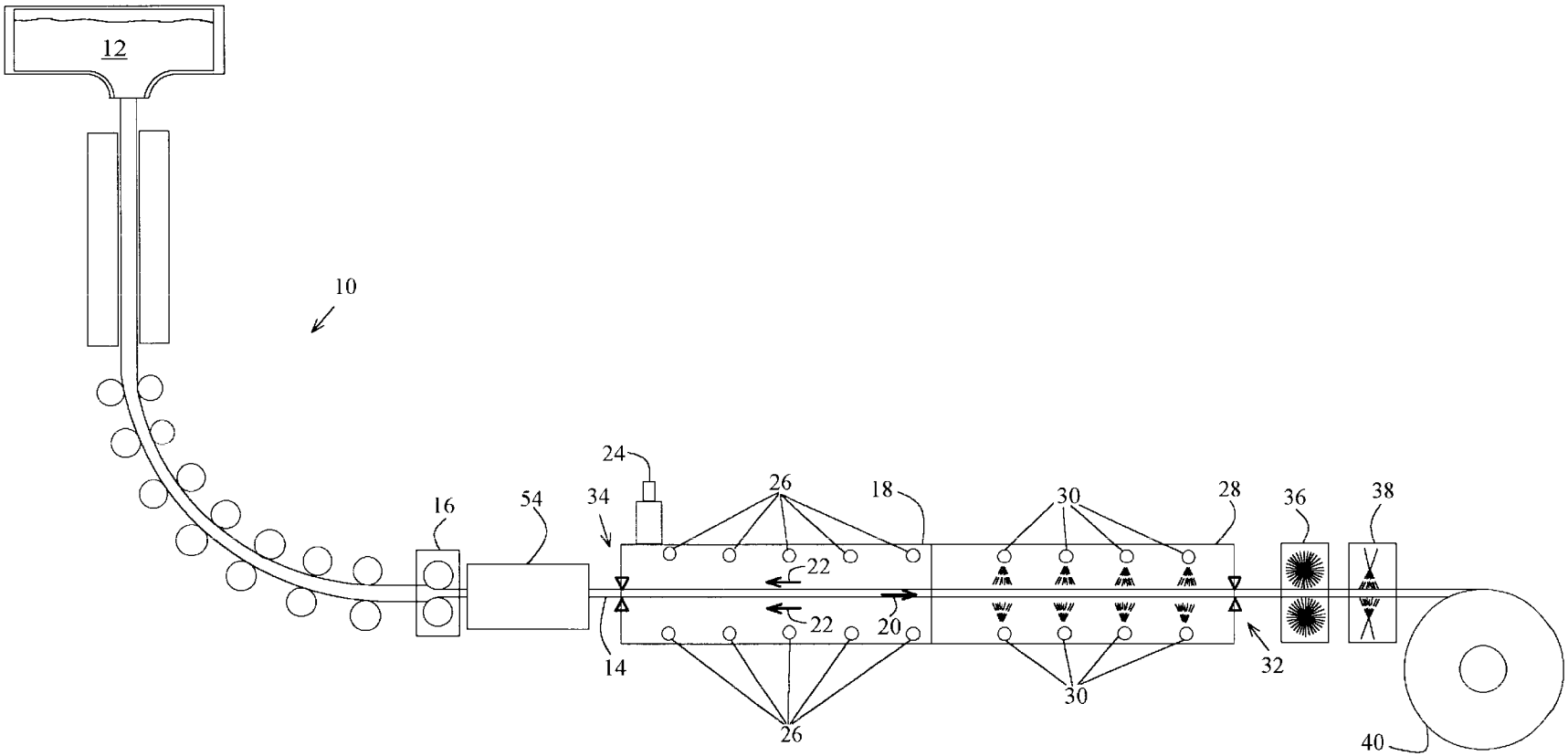
FIG. 6 is a schematic illustration of an embodiment of the process and apparatus of the invention for producing scale-free thin strip which incorporates an accumulating device following a continuous caster system.

FIG. 6 depicts a scale-free thin metal strip processing line wherein a strip accumulating means is provided as a buffer between continuous caster system 10 and reducing chamber 18. Coil box 54 enclosing a strip coiler and a strip uncoiler can be used routinely during processing or can be by-passed and used solely when downstream equipment repairs, maintenance, or delays occur. Although means can be provided to prevent loss of strip temperature while in coil box 54, use of heaters 26 in reducing chamber 18 would most likely be necessary. Other suitable strip accumulating devices can also be used.

While specific materials, parameters, and processing steps have been set forth for purposes of describing embodiments of the invention, various modifications can be resorted to, in light of the above teachings, without departing from Applicant's novel contributions; therefore in determining the scope of the present invention reference should be made to the appended claims.

What is claimed is:

1. A method for the direct production of scale-free thin metal strip from molten metal, comprising:

casting hot thin metal strip from molten metal in a thin strip continuous casting system;

passing the hot thin metal strip through a reducing chamber, while the hot thin metal strip still retains heat from the molten metal so as to be at a temperature of above about 400° C. solely from said retained heat;

contacting the hot thin metal strip in the reducing chamber with a reducing gas to reduce oxides on the surfaces of the strip; then, prior to exposure to an oxidizing atmosphere, passing the thin metal strip through a cooling chamber, separate from said reducing chamber, having a non-oxidizing cooling gas, differing from said reducing gas, directed toward the strip surfaces, and cooling the hot thin metal strip in the cooling chamber to a temperature of below about 150° C., to provide a cooled, thin metal strip.

2. A method for the direct production of scale-free thin metal strip from molten metal as defined in of claim 1, wherein the cooled thin metal strip is formed into a coil.

3. The method for the direct production of scale-free thin metal strip from molten metal as defined in claim 1, wherein the hot thin metal strip is decreased in thickness to a predetermined gage by hot rolling prior to passing the strip through the reducing chamber.

4. The method for the direct production of scale-free thin metal strip from molten metal as defined in claim 3, wherein, after decreasing in thickness, the cooled thin metal strip has a thickness of between about 0.3 to 3.5 mm.

5. The method for the direct production of scale-free thin metal strip from molten metal as defined in claim 1, wherein, after cooling to a temperature below about 150° C., the cooled thin metal strip is decreased in thickness to a predetermined gage by cold rolling.

6. The method for the direct production of scale-free thin metal strip from molten metal as defined in claim 5, wherein, after decreasing in thickness, the cooled thin metal strip has a thickness of between about 0.3 to 3.5 mm.

7. The method for the direct production of scale-free thin metal strip from molten metal as defined in claim 1, wherein said hot thin metal strip has a thickness of between about 0.5 to 4 mm.

8. The method for the direct production of scale-free thin metal strip from molten metal as defined in claim 1, wherein the thin metal strip is brushed after cooling.

9. The method for the direct production of scale-free thin metal strip from molten metal as defined in claim 8, wherein the brushed thin metal strip is decreased in thickness to a predetermined gage by cold rolling.

10. The method for the direct production of scale-free thin metal strip from molten metal as defined in claim 8, wherein the brushed thin metal strip has a coating applied to at least one of the surfaces.

11. The method for the direct production of scale-free thin metal strip from molten metal as defined in claim 10, wherein the coating is oil.

12. The method for the direct production of scale-free thin metal strip from molten metal as defined in claim 1, wherein the thin metal strip is sheared into discreet pieces after cooling.

13. The method for the direct production of scale-free thin metal strip from molten metal as defined in claim 1, wherein the thin metal strip has a coating applied to at least one of the surfaces after cooling.

14. The method for the direct production of scale-free thin metal strip from molten metal as defined in claim 13, wherein the coating is oil.

15. The method for the direct production of scale-free thin metal strip from molten metal as defined in claim 1, wherein, after cooling, at least one of the surfaces of the cooled thin metal strip is re-textured.

16. The method for the direct production of scale-free thin metal strip from molten metal as defined in claim 1, wherein the hot thin metal strip cast from the continuous caster system is accumulated prior to passing the strip through the reducing chamber to reduce surface oxides.

17. The method for the direct production of scale-free thin metal strip from molten metal as defined in claim 1, wherein, the hot thin metal strip is decreased in thickness to a predetermined gage by hot rolling prior to passing the strip through the reducing chamber, and following cooling to a temperature below about 150° C. the cooled thin metal strip is further decreased in thickness to a predetermined gage by cold rolling.

18. The method for the direct production of scale-free thin metal strip from molten metal as defined in claim 1, wherein the hot thin metal strip, while retaining heat from the molten metal, is below about 400° C., and is heated to at least about 400° C. upon passing through the reducing chamber.

19. The method for the direct production of scale-free thin metal strip from molten metal as defined in claim 18, wherein the cooled thin metal strip is formed into a coil.

20. The method for the direct production of scale-free thin metal strip from molten metal as defined in claim 18, wherein the hot thin metal strip is decreased in thickness to a predetermined gage by hot rolling prior to passing through the reducing chamber.

21. The method for the direct production of scale-free thin metal strip from molten metal as defined in claim 20 wherein, after decreasing in thickness, the cooled thin metal strip has a thickness of between about 0.3 to 3.5 mm.

22. The method for the direct production of scale-free thin metal strip from molten metal as defined in claim 18, wherein, after cooling to a temperature below about 150° C., the cooled thin metal strip is decreased in thickness to a predetermined gage by cold rolling.

23. The method for the direct production of scale-free thin metal strip from molten metal as defined in claim 22 wherein, after decreasing in thickness, the cooled thin metal strip has a thickness of between about 0.3 to 3.5 mm.

24. The method for the direct production of scale-free thin metal strip from molten metal as defined in claim 18, wherein said hot thin metal strip has a thickness of between about 0.5 to 4 mm.

25. The method for the direct production of scale-free thin metal strip from molten metal as defined in claim 18, wherein the thin metal strip is brushed after cooling.

26. The method for the direct production of scale-free thin metal strip from molten metal as defined in claim 18, wherein the thin metal strip is sheared into discreet pieces after cooling.

27. The method for the direct production of scale-free thin metal strip from molten metal as defined in claim 18, wherein the thin metal strip has a coating applied to at least one of the surfaces after cooling.

28. The method for the direct production of scale-free thin metal strip from molten metal as defined in claim 27, wherein the coating is oil.

29. The method for the direct production of scale-free thin metal strip from molten metal as defined in claim 18, wherein, after cooling, at least one of the cooled thin metal strip is re-textured.

30. A method for the direct production of scale-free thin metal strip from molten metal as defined in claim 1, wherein the reducing gas in the reducing chamber is hydrogen, and the non-oxidizing gas in the cooling chamber is selected from hydrogen gas, an inert gas, and a mixture of hydrogen gas and an inert gas.

31. A method for the direct production of scale-free thin metal strip from molten metal, comprising:

casting hot thin metal strip from molten metal in a thin strip continuous casting system;

passing the hot thin metal strip, while the same still retains heat from the molten metal, directly to, and through, a reducing chamber, while the hot thin metal strip retains sufficient heat from the molten metal to be at a temperature of above about 400° C. solely from said retained heat;

contacting the hot thin metal strip in the reducing chamber with a reducing gas to reduce oxides on the surfaces of the strip; then, prior to exposure to an oxidizing atmosphere, passing the hot thin metal strip directly from the reducing chamber to a cooling chamber, separate from said reducing chamber, having a non-oxidizing cooling gas, differing from said reducing gas, directed toward the strip surface;

cooling the hot thin metal strip in the cooling chamber to a temperature of below about 150° C., prior to exposure to an oxidizing atmosphere, to provide a cooled thin metal strip; and forming the cooled thin metal strip into a coil.

32. The method for the direct production of scale-free thin metal strip from molten metal as defined in claim 31, wherein the hot thin metal strip is decreased in thickness to a predetermined gage by hot rolling prior to passing the strip through the reducing chamber.

33. The method for the direct production of scale-free thin metal strip from molten metal as defined in claim 31, wherein, after cooling to a temperature below about 150° C., the cooled thin metal strip is decreased in thickness to a predetermined gage by cold rolling.

34. A method for the direct production of scale-free thin metal strip from molten metal as defined in claim 31, wherein the reducing gas in the reducing chamber is hydrogen, and the non-oxidizing gas in the cooling chamber is selected from hydrogen gas, an inert gas, and a mixture of hydrogen gas and an inert gas.

* * * * *